US006576829B1

(12) United States Patent
Hart

(10) Patent No.: US 6,576,829 B1
(45) Date of Patent: Jun. 10, 2003

(54) ELECTRONIC PERCUSSION INSTRUMENT WITH TRANSDUCER SOLDERING CONNECTION PROTECTION

(76) Inventor: Peter Hart, 609 Second Ave., Destin, FL (US) 32541

( * ) Notice: Subject to any disclaimer, the term of this patent is extended or adjusted under 35 U.S.C. 154(b) by 0 days.

(21) Appl. No.: 10/053,746

(22) Filed: Jan. 17, 2002

(51) Int. Cl.[7] ..... G10H 1/02

(52) U.S. Cl. ..... 84/737; 84/738; 84/743; 84/104; 84/411 R

(58) Field of Search ..... 84/723, 725, 730, 84/737–738, 743, 104, 411 R, 411 P

(56) References Cited

U.S. PATENT DOCUMENTS

| | | | | | |
|---|---|---|---|---|---|
| 4,947,725 A | * | 8/1990 | Nomura | ..... | 84/723 |
| 5,105,710 A | * | 4/1992 | Rothmel | ..... | 84/730 |
| 5,293,000 A | * | 3/1994 | Adinolfi | ..... | 84/730 |
| 6,271,458 B1 | * | 8/2001 | Yoshino et al. | ..... | 84/738 |

* cited by examiner

*Primary Examiner*—Marlon T. Fletcher
(74) *Attorney, Agent, or Firm*—George A. Bode; Lisa D. Velez; Bode & Associates

(57) ABSTRACT

An electronic percussion instrument which includes a housing suspended from the bottom end of the barrel which houses the percussive impact sensor. The percussive impact sensor includes transducer. The arrangement of the percussive impact sensor and the housing maximizes the distance of the transducer from the percussion head.

17 Claims, 2 Drawing Sheets

ELECTRONIC PERCUSSION INSTRUMENT WITH TRANSDUCER SOLDERING CONNECTION PROTECTION

BACKGROUND OF THE INVENTION

1. Field of the Invention

The present invention relates electronic percussion instruments or drums and, more particularly, to an electronic percussion instrument which maximizes the distance of the transducer from the percussion head to protect the transducer and solder connections to the transducer and improve the output "smoothing out" of the resulting output waveform of the transducer.

2. General Background

In the past, the transducer has been supported within the barrel of the electronic percussion instrument and was supported at a location generally close to the percussion head with the cushioning member is in contact with the solder connections on the transducer. However, I have determined that such a design compromises the soldered connections of the transducer. For example, U.S. Pat. No. 6,121,538, entitled "ELECTRONIC PERCUSSION INSTRUMENTAL SYSTEM AND PERCUSSION DETECTING APPARATUS THEREIN" locates the transducer and it support member within the barrel.

As will be seen more fully below, the present invention is substantially different in structure, methodology and approach from that of prior electronic percussion instruments.

SUMMARY OF THE PRESENT INVENTION

The preferred embodiment of electronic percussion instrument of the present invention solves the aforementioned problems in a straight forward and simple manner.

Broadly, the present invention contemplates an electronic percussion instrument comprising a barrel having a top end and a bottom end and a length; a percussion head secured to said top end; and, an electronic percussion detecting assembly having a means for housing affixed to and suspended externally from the bottom end and means for sensing percussive impact to the percussion head housed in the housing means. The sensing means has means for cushioning journalled through the housing means and the barrel to the percussion head.

In view of the above, an object of the present invention is to provide a housing means which houses the sensing means at a location which maximizes the distance of the transducer from the percussion head.

Another object of the present invention is to provide a percussion surface which has excellent percussion feeling while minimizing the percussion sound so that it is very quite.

A further object of the present invention is to provide an electronic percussion instrument which minimized "hot spots" so that more natural dynamics such as that from an acoustic drum can be achieved.

A still further object of the present invention is to provide a sensor plate which enhances the diffusion of the percussion impact to the percussion head and acts as a protective barrier for the piezo transducer.

A still further object of the present invention is to provide an electronic percussion instrument which includes an isolation pad between the support plate and the sensor plate to diffuse sympathetic vibrations which would otherwise be transduced by the transducer.

In view of the above, a feature of the present invention is to provide an electronic percussion instrument which is easy to use and play.

Another feature of the present invention is to provide an electronic percussion instrument that is very durable even when the instrument is repeatedly struck with a stick.

A further feature of the present invention is to provide an electronic percussion instrument which is relatively simple structurally and thus simple to manufacture.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
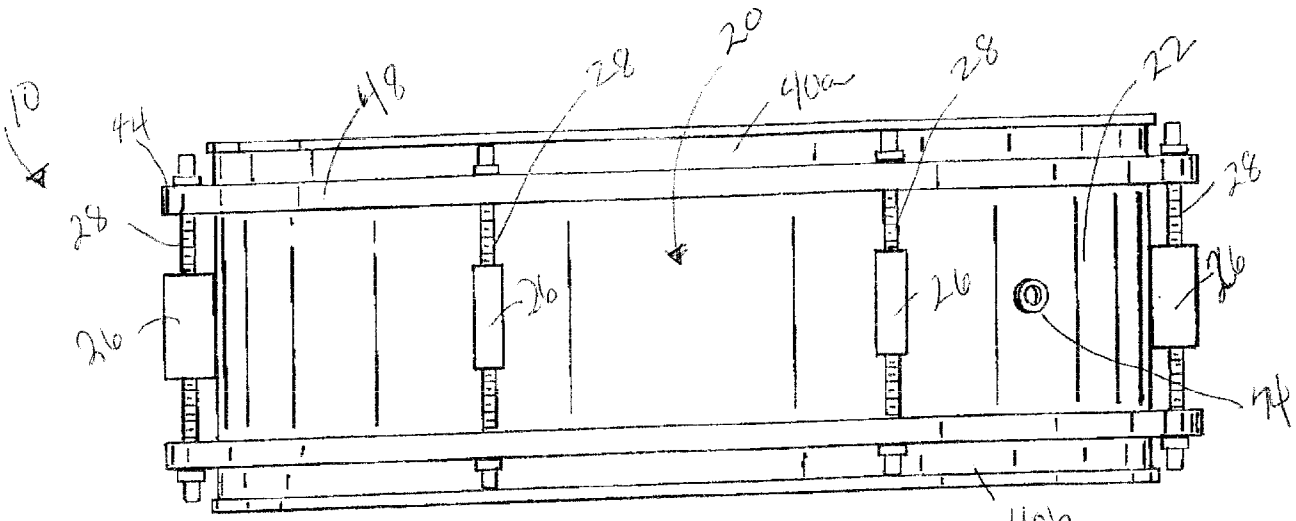
FIG. 1 illustrates a side view of the electronic percussion instrument of the present invention.
Figure 2:
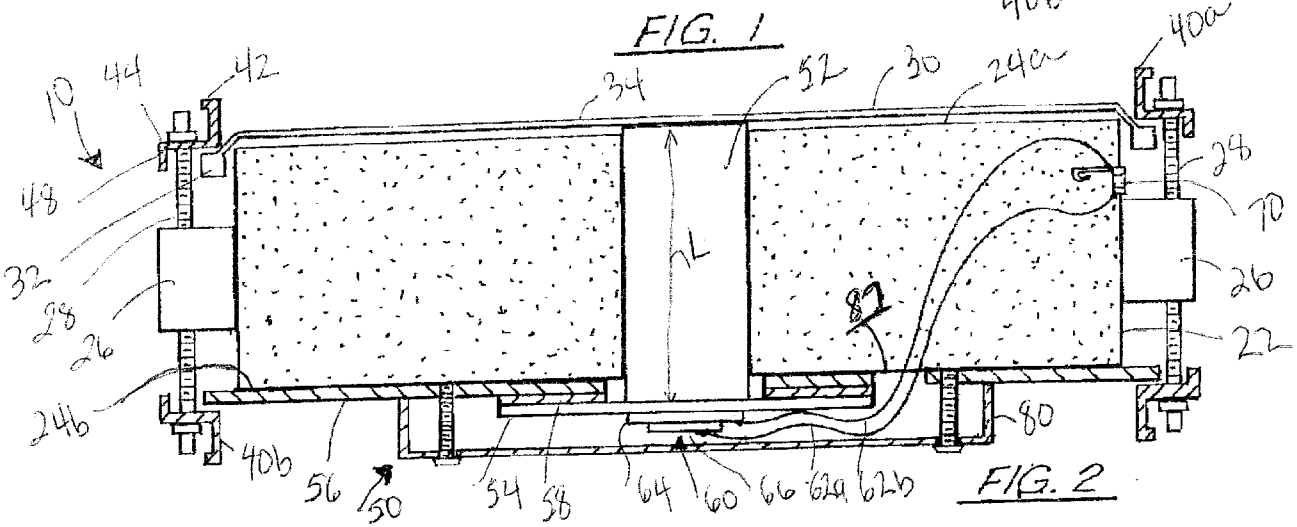
FIG. 2 illustrates a cross sectional view of the electronic percussion instrument of the embodiment of FIG. 1; and, FIG. 3 illustrates an exploded view of the electronic percussion instrument of the present invention.
Figure 3:
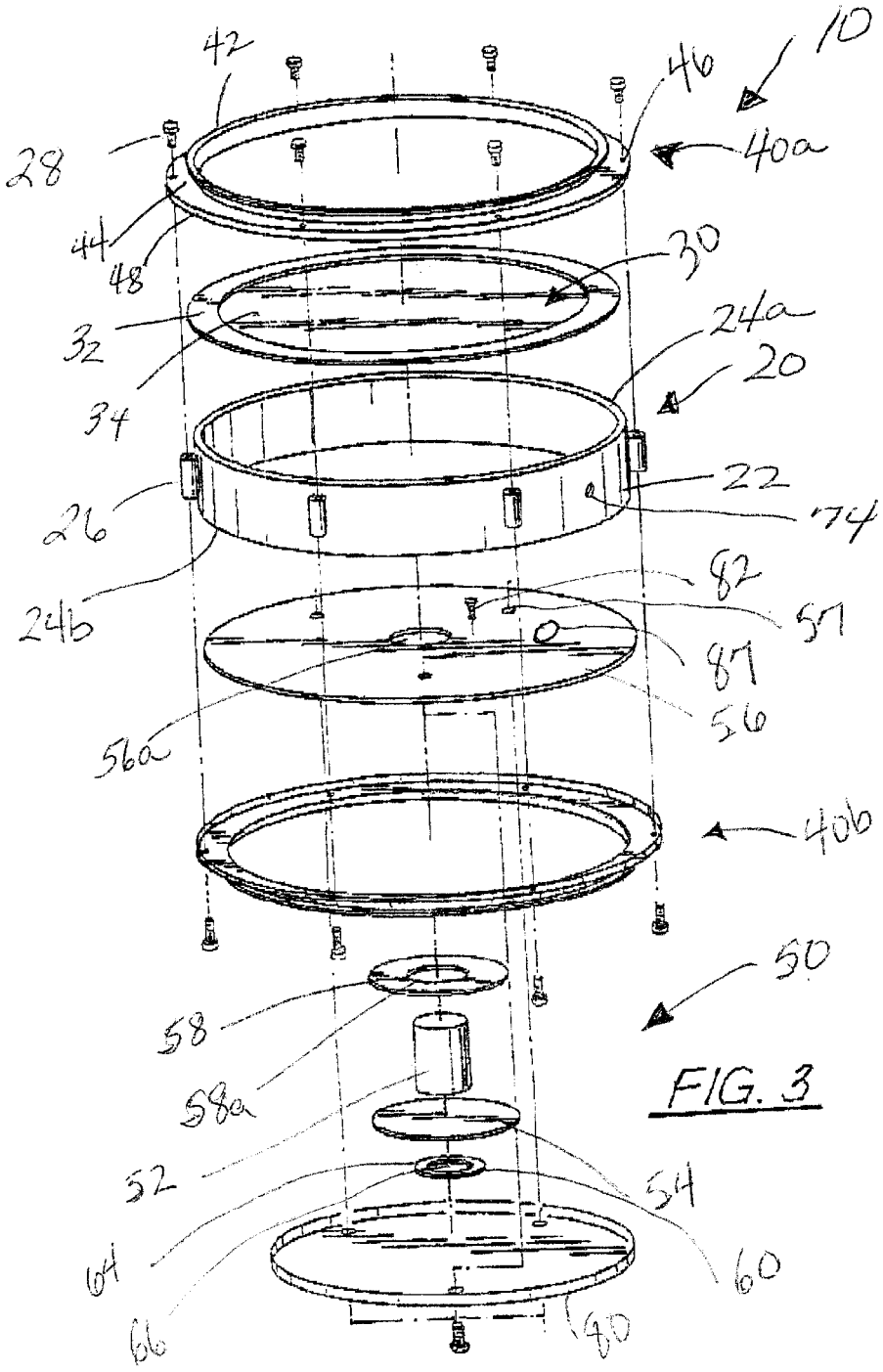

Referring now to the drawings and in particular FIGS. 1–3, the electronic percussion instrument of the present invention is generally referenced by the numeral 10. In the exemplary embodiment, the electronic percussion instrument 10 is an electronic drum. Hence the electronic percussion instrument 10 will be described in detail as related to a drum for illustrative purposes. However, the inventive concepts described herein below are not limited to drums.

The electronic percussion instrument 10 is generally comprised of a drum barrel 20 having a top end 24*a* and a bottom end 24*b* and a top-mounted percussion head 30 secured to the top end 24*a* of the drum barrel 20 via a top rim 40*a*. The top rim 40*a* is used to hold the top-mounted percussion head 30 to drum barrel 20 in a variable tensioned state. The electronic percussion instrument 10 further comprises an electronic percussion detecting assembly 50 which detects percussion strikes applied to the top-mounted percussion head 30 as the instrument 10 is played and creates an electric signal.

On the outer circumferential surface 22 of the barrel there are a plurality of spaced receivers 26 which receive threaded screw or rod members 28. The top rim 40*a* is preferably made of metallic material and is comprised of a upright ring member 42 having perpendicularly coupled to the bottom thereof a circular flange 44. The circular flange 44 includes a plurality of spaced apertures 46 which are aligned to receive a respective one of the screw or rod members 26 to secure or clamp down the top rim 40*a* on top of the percussion head 30 and to the top end 24*a* of the barrel 20. The outer circumferential edge of the circular flange 44 has coupled thereto a lower depending ring member 48 which is essentially concentric with the upright ring member 42 but extends in a downward direction.

Barrel 20 includes aperture 74 through which jack 70 is secured. Jack 70 is adapted to receive a plug (NOT SHOWN) from a control device (NOT SHOWN) which translates the electric signal from the transducer 60 to synthesized percussive sound.

The percussion head 30 includes a frame 32 having affixed thereto, such as through bonding, a screen material tightly stretched about the frame 32 to provide a firm percussion or striking surface 34. The screen material has openings to permit air to flow therethrough. Thereby, as the firm percussion or striking surface 34 is struck, the noise from the percussion impact is very quite. The circular flange 44 applies pressure to the frame 32 to clamp down the percussion head 30. The screen material forming the firm percussion or striking surface 34 may include one or two layers of woven material.

A drum head is commonly made of MYLAR and is available from a variety of manufacturers in various thicknesses, weights, and layers. Many manufacturers apply coatings to vary the tonality and also to provide a rough texture for playing with brushes. More recently, a variety of manufacturers have offered drumheads which are made of net-like material. These are also available in various thicknesses, weights and layers. These heads are commonly used on acoustic drums for practicing at reduced volumes. HART DYNAMICS, of Destin, Florida, manufactures one (1) ply and two (2) ply heads of a screen-like material under the trademark KONTROL SCREEN™.

The firm percussion or striking surface 34 is stretched in tension so that the surface 34 is generally elastic or resilient and simulates the striking surface of an acoustic drum. In operation, the electronic percussion detecting assembly 50 transduces a variety of percussive impacts to the firm percussion or striking surface 34, such as from a drum stick, drum brush and other drumming implements. Furthermore, the firm percussion or striking surface 34 may be provided with a percussion point indicia (NOT SHOWN).

Referring now to the electronic percussion detecting assembly 50, the electronic percussion detecting assembly 50 is comprised of cushioning member 52, a sensor plate 54 coupled to a bottom surface of the cushioning member 52 and a transducer 60 affixed to an underside of the sensor plate 54. The cushioning member 52 is a solid cylindrically-shaped geometric structure which has a length L along its longitudinal axis which is greater than the length of the barrel 20 and is generally concentric within the barrel 20. The geometric structure of the cushioning member 52 is mounted so that its longitudinal axis is essentially aligned in the center of the firm percussion or striking surface 34. As will be described in more detail below, the length L of the cushioning member 52 locates the transducer 60 outside of the barrel 20 and maximizes the distance between the transducer 60 and the percussion head 30. The top and bottom surfaces of geometric structure are generally flat wherein the top surface essentially, abuts (comes in surface-to-surface contact with) the underside of the firm percussion or striking surface 34 in a manner which does not dent, bend, or create a protrusion in the firm percussion or striking surface 34.

The electronic percussion detecting assembly 50 further comprises a support plate 56 and isolation pad 58 mounted to the underside of the support plate 56. The cushioning member 52 is journalled through the center of the support plate 56 and the isolation pad 58 via center apertures 56*a* and 58*a*, respectively.

The support plate 56 is a planar disc shaped surface that has an outer circumference which is at least the size of the outer circumference of the barrel 20. Thereby, the support plate 56 is mounted to the bottom end of barrel 20 in a manner (clamped down) similar to the percussion head 30 via bottom rim 40*b*. Bottom rim 40*b* is similar to top rim 40*a*. Therefore, no further discussion is necessary regarding the bottom rim 40*b*.

It should be noted that the support plate 56 is not limited to a disk-shaped plate, but may be square, rectangular, triangular, etc., as long as its overall shape can be held adjacent to the barrel by the bottom rim 40*b*. Furthermore, geometric shapes of the sensor plate 54 and the isolation pad 58 are not limited to a disk shape, but may be square, rectangular, triangular, etc.

The cushioning member 52 is made of a resilient or elastic material such as rubber, sponge or the like. The cushioning member 52 contacts the underside of the firm percussion or striking surface 34 of the percussion head 30 and the top surface of the sensor plate 54. The surface area of the cushioning member 52 which comes in contact with the firm percussion or striking surface 34 is much less than the entire surface of the firm percussion or striking surface 34. Since the cushioning member 52 is used to transduce the impact upon the firm percussion or striking surface 34 to the sensor plate 54 and furthermore to the transducer 60, the cushioning member 52 should have a sufficient amount of surface area in surface-to-surface contact with the firm percussion or striking surface 34. Thereby, as the surface area of the top surface of the cylindrical cushioning member 52 contacts the percussion head 30 in a substantially larger area "hot spots" are eliminated. Moreover, the percussion head 30 responds in a manner similar to an acoustic drum. In other words, the larger surface area of the cylindrical cushioning member 52 in contact with the percussion head 30 diffuses the impact strike on the percussion head 30 and allows for much more natural dynamics, such as that of an acoustic drum, while eliminating the "hot spots".

For example, U.S. Pat. No. 6,121,538, entitled "ELECTRONIC PERCUSSION INSTRUMENTAL SYSTEM AND PERCUSSION DETECTING APPARATUS THEREIN" provides for a conical cushioning member that has a relatively small surface area which contacts the drum head. The problem with such a design is that when the drum is impacted head on the center axis, the transducer perceives this as an extremely loud strike. By moving slightly off such center axis the same velocity strike is perceived as a softer strike. This creates what is commonly referred to as a "hot spot". This "hot spot" makes it extremely difficult to achieve natural dynamics when playing.

Referring now to the isolation pad 58, the isolation pad 58 is used to isolate and separate the support plate 56 from the sensor plate 54. The isolation pad 58 is a planar disc shaped surface which is generally made of rubber or the like. In other words, the isolation pad 58 serves as a rubber gasket. The isolation pad 58 and the sensor plate 54 have substantially the same circumference which is much less than the circumference of the support plate 56.

The electronic percussion instrument 10 may be used in singular form or in a drum set configuration utilizing different sizes to closely approximate an acoustic drum set. In order to position the drums set around the drummer, the drums are commonly held in place using individual stands or with a drum rack system. A drum rack system consists of a variety of metal pipe that are clamped together to form a frame in which to hold the individual drums or electronic percussion instruments 10. The inherent problem with a drum rack system is that when used with a transducer 60 to transduce the percussive impact on a individual percussion head 30, the control device (NOT SHOWN) has a difficult time determining whether an individual electronic percussion instrument 10 has been played or if it is just receiving sympathetic vibrations through the stand from another electronic percussion instrument 10 of the set. The isolation pad 58 is used to diffuse such sympathetic vibrations from the sensor plate 54.

The sensor plate 54 further enhances the diffusion of the strike on the percussion head 30. The sensor plate 54 also acts as a protective barrier for the piezo transducer 60. The transducer 60 is in general a delicate device consisting of a brass diaphragm 64 and a lead zirconium titanium (PZT) disk 66. The PZT disk 66 is coated with a layer of silver to which the wire 62*a*, that carries the signal from the transducer 60 to jack 70, is soldered. Wire 62*b* is soldered to the brass diaphragm 64 and to jack 70. However, the soldered connections are generally not very durable in an environment where the soldered connection is constantly subjected to strong percussion impacts.

While not wishing to be bound by theory, I believe that maximizing the distance between the point of impact, which occurs at the percussion head 30, and the transducer 60/soldered connection minimizes complications associated with the soldered connection over time as the instrument 10 is played. Furthermore, the resulting output of the transducer 60 is improved and "smoothed out."

The electronic percussion detecting assembly 50 further comprises a cover 80 which creates a chamber or compartment for protecting the electronic percussion detecting assembly 50 exterior of the barrel 20 and, especially, the soldered connections to the transducer 60.

The support plate 56 has a plurality of holes 57 formed therein between its outer circumferential edge and the outer circumferential edge of the isolation pad 58. The holes receive threaded screws 82 or the like to fasten the cover 80 thereto. The support plate 56 further includes hole 87 for journalling therethrough, the wires 62*a* and 62*b*that carries the signal from the transducer 60 to jack 70.

In summary, the electronic percussion detecting assembly 50 includes a housing which supports the means for sensing the percussive impact to the percussion head 30 at a location exterior of the barrel 20 to maximize the distance of the transducer from the point of impact. The housing includes the support plate 56 and cover 80. The support plate 56 is clamped to the bottom end 24*b* of the barrel 20 and suspends therefrom the means for sensing the percussive impact within the housing. Since the support plate 56 would be subject to vibrations due to percussive impact, the isolation pad 58, diffuses vibrations to the housing structure, namely, the support plate 56 so that the means for sensing the percussive impact operates properly to transduce percussive impacts to the percussion head 30.

Moreover, the prior art devices position their transducer with the brass diaphragm on the bottom, the PZT or quartz disk on top and the solder connections contacting the cushioning member facing the drum (percussion) head. As a result, the solder connections receive direct impact transmitted by the cushioning member. The present invention not only fastens the transducer 60 to the bottom of a protective steel sensor plate 54, but the transducer 60 itself is inverted so that the solder connections receive no direct impact through the cushioning member 52.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. An electronic percussion instrument comprising:

a barrel having a top end and a bottom end and a length;

a percussion head secured to said top end;

cushioning member journalled through the barrel from the bottom end and having a top surface positioned in surface-to-surface contact with the percussion head, a length which is greater than the length of the barrel and a bottom surface;

a transducer for transducing percussion impact applied to the percussion head into an electric signal and which is disposed adjacent said bottom surface;

a support plate having a planar disc shaped surface with a center aperture formed therein and an outer circumference which is at least the size of an outer circumference of said bottom end of said barrel; and, an isolation pad secured to an underside of said support plate exterior of said barrel and having a planar disc shaped surface with a center aperture formed therein and an outer circumference which has a size less than the outer circumference of the support plate; and, a sensor plate having coupled in a center thereof said bottom surface of the cushioning member and which is coupled to an underside of the isolation pad.

2. The instrument of claim 1, wherein said transducer is coupled to an underside of the sensor plate.

3. The instrument of claim 2, further comprising:

a cover coupled to said support plate wherein disposed within said cover includes said transducer, said sensor plate, said isolation pad and a portion of said cushioning member.

4. The instrument of claim 1, further comprising:

a top rim for securing the percussion head to said top end of said barrel; and, a bottom rim for securing the support plate to the bottom end of said barrel.

5. The instrument of claim 1, wherein said cushioning member is cylindrically shaped with a longitudinal axis journalled within a center axis of said barrel wherein the longitudinal axis is aligned with a center of the percussion head.

6. The instrument of claim 1, wherein said percussion head is comprises of a screen material through which air passes.

7. An electronic percussion instrument comprising:

a barrel having a top end and a bottom end and a length;

a percussion head secured to said top end; and, an electronic percussion detecting assembly having a means for housing affixed to and suspended externally from said bottom end and means for sensing percussive impact to the percussion head housed in said housing means, said sensing means has means for cushioning journalled through said housing means and said barrel to said percussion head, said housing means comprising:

a support plate having a planar disc shaped surface with a center aperture formed therein and an outer circumference which is at least the size of an outer circumference of said bottom end of said barrel;

a means for covering coupled to said supporting plate to form a closed chamber;

an isolation pad secured to an underside of said support plate exterior of said barrel and having a planar disc shaped surface with a center aperture formed therein and an outer circumference which has a size less than the outer circumference of the support plate; and, a sensor plate having coupled in a center thereof said bottom surface of the cushioning means and which is coupled to an underside of the isolation pad.

8. The instrument of claim 7, wherein said sensing means further comprises:

a sensor plate having coupled in a center thereof a bottom surface of said cushioning means and which is coupled to an underside of said isolating means.

9. The instrument of claim 8, wherein said sensing means includes a means for transducing and which is coupled to an under side of said sensor plate.

10. The instrument of claim 7, wherein said sensing means includes a means for transducing and which is constructed and arranged in said housing to maximize a distance of said transducer from said percussion head.

11. The instrument of claim 7, further comprising:

a top rim for securing the percussion head to said top end of said barrel; and, a bottom rim for securing said housing means to said bottom end of said barrel.

12. The instrument of claim 7, wherein said cushioning means is resilient or elastic cylindrically shaped structure with a longitudinal axis journalled within a center axis of said barrel wherein the longitudinal axis is aligned with a center of the percussion head.

13. The instrument of claim 7, wherein said percussion head is comprises of a screen material through which air passes.

14. A method of manufacturing an electronic percussion instrument comprising the steps of:

providing a barrel having a top end and a bottom end and a length;

securing a percussion head to said top end;

affixing and suspending externally from said bottom end a housing;

arranging and housing a percussive impact sensor having a transducer in said housing to maximize a distance between the transducer and the percussion head;

providing a supporting plate to the bottom end of the barrel, said support plate having a planar disc shaped surface with a center aperture formed therein and an outer circumference which is at least the size of an outer circumference of said bottom end of said barrel;

providing an isolation pad secured to an underside of said support plate exterior of said barrel and having a planar disc shaped surface with a center aperture formed therein and an outer circumference which has a size less than the outer circumference of the support plate;

providing a sensor plate having coupled in a center thereof said bottom surface of the cushioning member and which is coupled to an underside of the isolation pad; and, said affixing and suspending step includes the steps of:

providing said supporting plate; and, isolating said supporting plate from said percussive impact sensor via an isolating surface.

15. The method of claim 14, wherein the affixing and suspending step further includes the step of:

creating a closed chamber with a cover coupled to said supporting plate.

16. The method of claim 15, further comprising the step of:

journalling a cushioning member of said percussive impact sensor from said percussion head through said barrel and into said closed chamber;

coupling a sensor plate of said percussive impact sensor to a bottom surface of said cushioning member and to an underside of said isolating surface; and, coupling the transducer of said percussive impact sensor to an underside of said sensor plate.

17. The method of claim 16, wherein said cushioning member is resilient or elastic cylindrically shaped structure with a longitudinal axis journalled within a center axis of said barrel wherein the longitudinal axis is aligned with a center of the percussion head.

* * * * *